United States Patent [19]

Taylor

[11] Patent Number: 4,699,222

[45] Date of Patent: Oct. 13, 1987

[54] METHOD AND APPARATUS FOR PENETRATING ICE

[75] Inventor: Owen S. Taylor, Jeannette, Pa.

[73] Assignee: Westinghouse Electric Corp., Pittsburgh, Pa.

[21] Appl. No.: 896,567

[22] Filed: Aug. 14, 1986

Related U.S. Application Data

[63] Continuation of Ser. No. 765,461, Aug. 14, 1985, abandoned.

[51] Int. Cl.[4] ..... F25C 5/04

[52] U.S. Cl. ..... 175/18; 299/24

[58] Field of Search ..... 175/18; 299/3, 17, 24; 405/61, 217

[56] References Cited

U.S. PATENT DOCUMENTS

| | | | |
|---|---|---|---|
| 2,251,916 | 8/1941 | Cross | 175/67 |
| 4,256,188 | 3/1981 | Hopkins et al. | 299/24 |
| 4,433,737 | 2/1984 | Malloy | 175/67 |

*Primary Examiner*—Stephen J. Novosad
*Assistant Examiner*—William P. Neuder
*Attorney, Agent, or Firm*—D. Schron

[57] ABSTRACT

Apparatus which penetrates a hole through an ice cap from the water beneath the ice cap. A positively buoyant unit containing water under high pressure discharges the water through a nozzle causing erosion of the ice. The nozzle is connected to a telescopic tube arrangement the total length of which is at least equal to the ice thickness so that when penetration is made the tube arrangement can act as an antenna for a surveillance sensor package carried by the unit.

17 Claims, 6 Drawing Figures

METHOD AND APPARATUS FOR PENETRATING ICE

This application is a continuation of application Ser. No. 765,461 filed Aug. 14, 1985, now abandoned.

BACKGROUND OF THE INVENTION

1. Field of the Invention

The invention in general relates to apparatus for producing a hole in a thick ice cap covering a body of water.

2. Description of the Prior Art

In underwater survey or surveillance missions, sensors are deployed in the water medium for gathering data and transmitting the data to a remote location.

If the data gathering operation is conducted in cold regions, such as the Arctic, a relatively thick ice cap may be covering the surface of the water. Accordingly, a need exists for apparatus capable of penetrating the ice cap from the water side so that an antenna may be extended therethrough for data transmission to the remote location.

The present invention is a relatively simple and highly reliable apparatus to accomplish the required penetration of the ice cap.

SUMMARY OF THE INVENTION

A hole is produced in an ice cap from the water medium underneath the ice cap by supplying a nozzle with high pressure fluid and advancing the nozzle during high pressure fluid discharge from the nozzle. An elongated containment vessel has a central support tube therein with one end being closed off by a fluid admission valve and the other end being open to the ambient medium. A tube arrangement is disposed within the support tube and is extendable therefrom and includes a nozzle connected to the end of the tube arrangement so as to extend therewith.

Means for imparting positive buoyancy to the apparatus is included so that after deployment in the water medium the apparatus will contact the underside of the ice cap. Means are additionally provided for separating the inside of the containment vessel into respective fluid and high pressure gas chambers such that when the fluid admission valve is opened high pressure fluid will be discharged from the nozzle and will extend the tube arrangement, while the fluid exiting the nozzle erodes the ice to form a channel therethrough to the surface.

DESCRIPTION OF THE PREFERRED EMBODIMENTS

Figure 1:
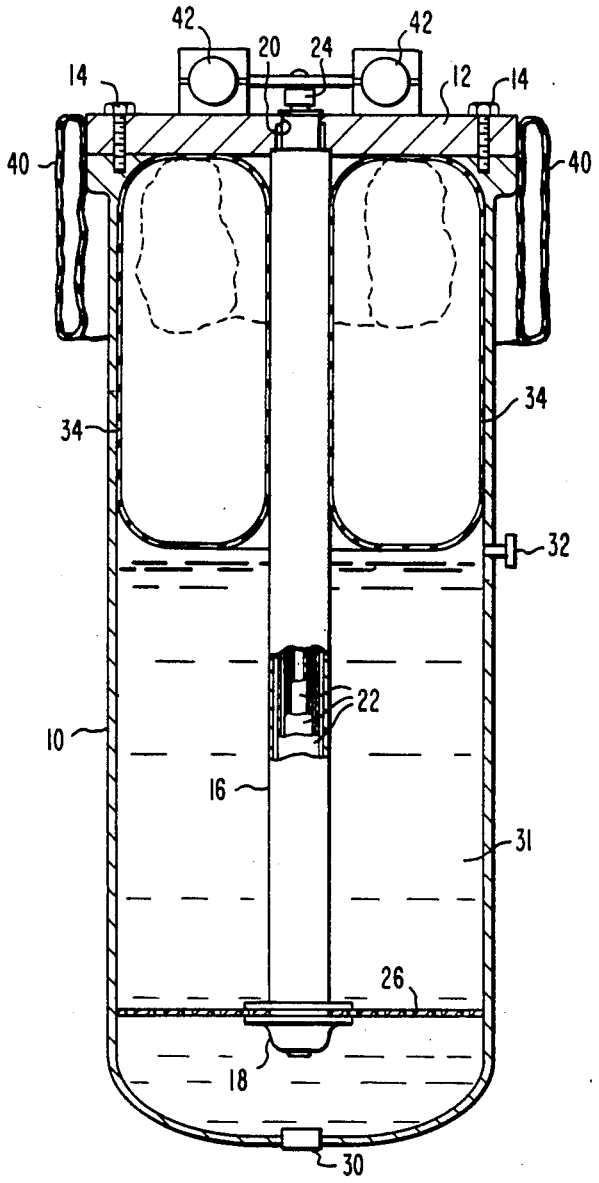
FIG. 1 is a cross sectional view of one embodiment of the present invention, before deployment.

The ice penetrator apparatus of FIG. 1 includes an elongated containment vessel 10 having a cover 12 secured such as by means of bolts 14.

Centrally disposed within the containment vessel is a support tube 16 having a fluid admission valve 18 closing off one end thereof while its other end is open to the ambient medium by way of aperture 20 in cover member 12.

Support tube 16 contains an extendable tube arrangement 22, to be described, and to which is connected a nozzle 24 through which high pressure fluid will be discharged to accomplish the ice penetration function. The lower part of support tube 16 is restrained from lateral movement by means of a support member 26 contacting the inner walls of containment vessel 10 and which may contain a plurality of apertures so as to additionally act as a filter.

A fluid, such as water, is, by means of fill valve 30, introduced into the inside of containment vessel 10 up to the level of bleed valve 32. Means are provided for separating the inside of the containment vessel into respective fluid and high pressure gas chambers. In the embodiment of FIG. 1 this means takes the form of a flexible bladder 34 which is charged with high pressure gas such as air and expands from a rest position, shown dotted, to the expanded position shown in solid line and wherein the pressure may be in the order of 1,000 psi. During the expansion, air above the level of water 31 is expelled from the containment vessel through the bleed valve as the flexible bladder expands upon charging. Due to the bladder arrangement, the apparatus will have a tendency to right itself in the water and assume a vertical orientation even if it is deployed on its side.

Figure 2:
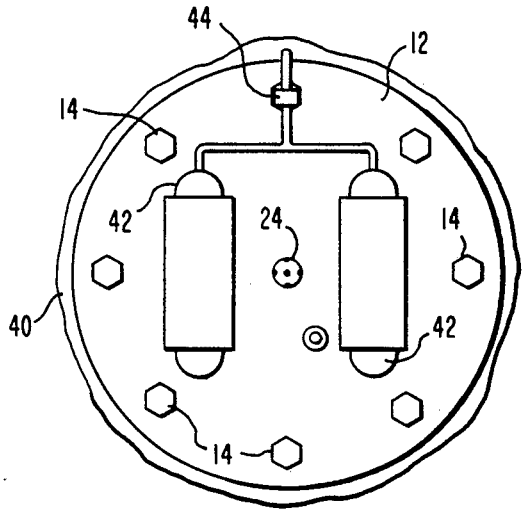
FIG. 2 is a plan view of the apparatus of FIG. 1.
Figure 3:
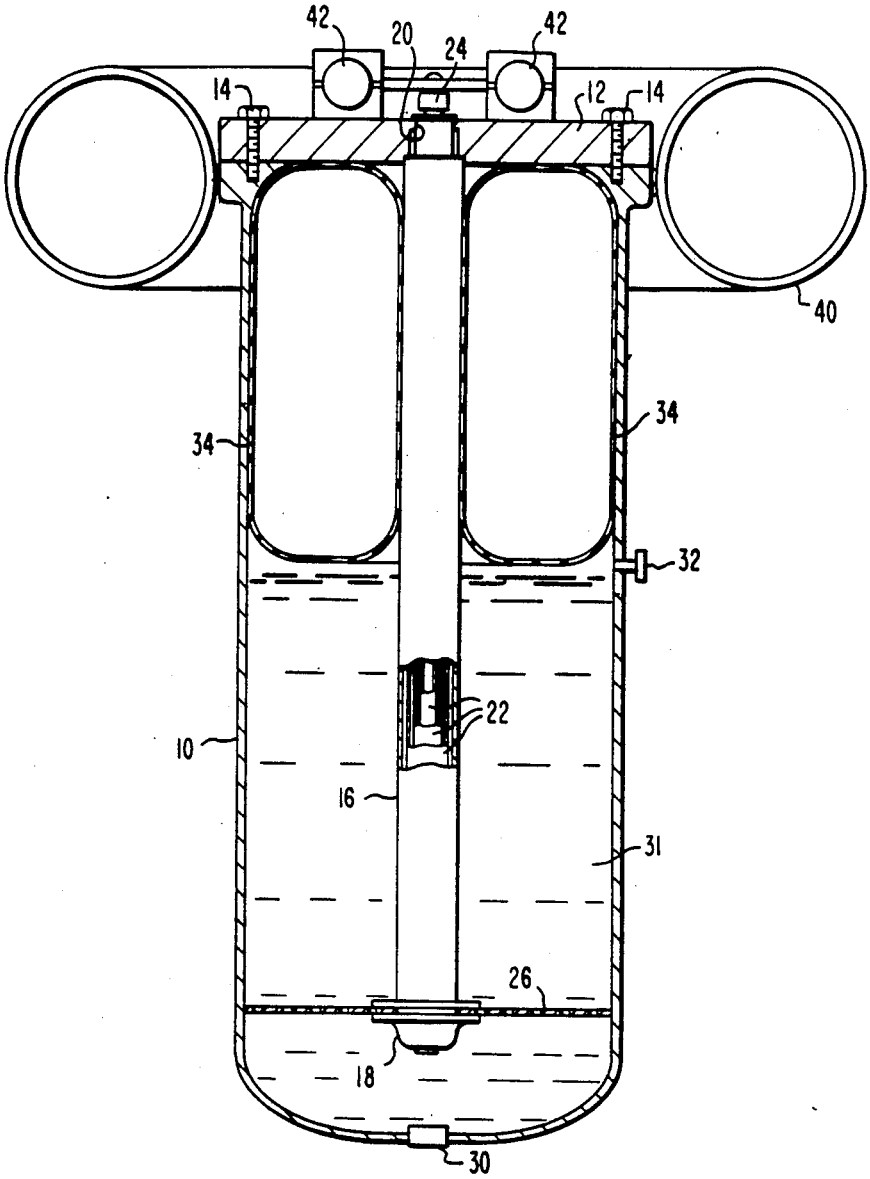
FIG. 3 illustrates the apparatus after deployment.

In FIG. 1, the apparatus has a slight negative buoyancy and would tend to drop to the bottom of the body of water in which the apparatus is deployed. Accordingly, means are provided for imparting positive buoyancy to the apparatus so that it may contact the undersurface of the ice cap to be penetrated. This means may take the form of a buoyancy collar 40 connected to the apparatus and shown in a deflated state in FIG. 1. Means for inflating the buoyancy collar takes the form of one or more gas cylinders 42 advantageously secured to cover 12 and, as illustrated in FIG. 2, connected to a valve 44 timed to open just after deployment so as to supply gas from cylinders 42 to the buoyancy collar 40 in order to inflate it as illustrated in FIG. 3.

Figure 4:
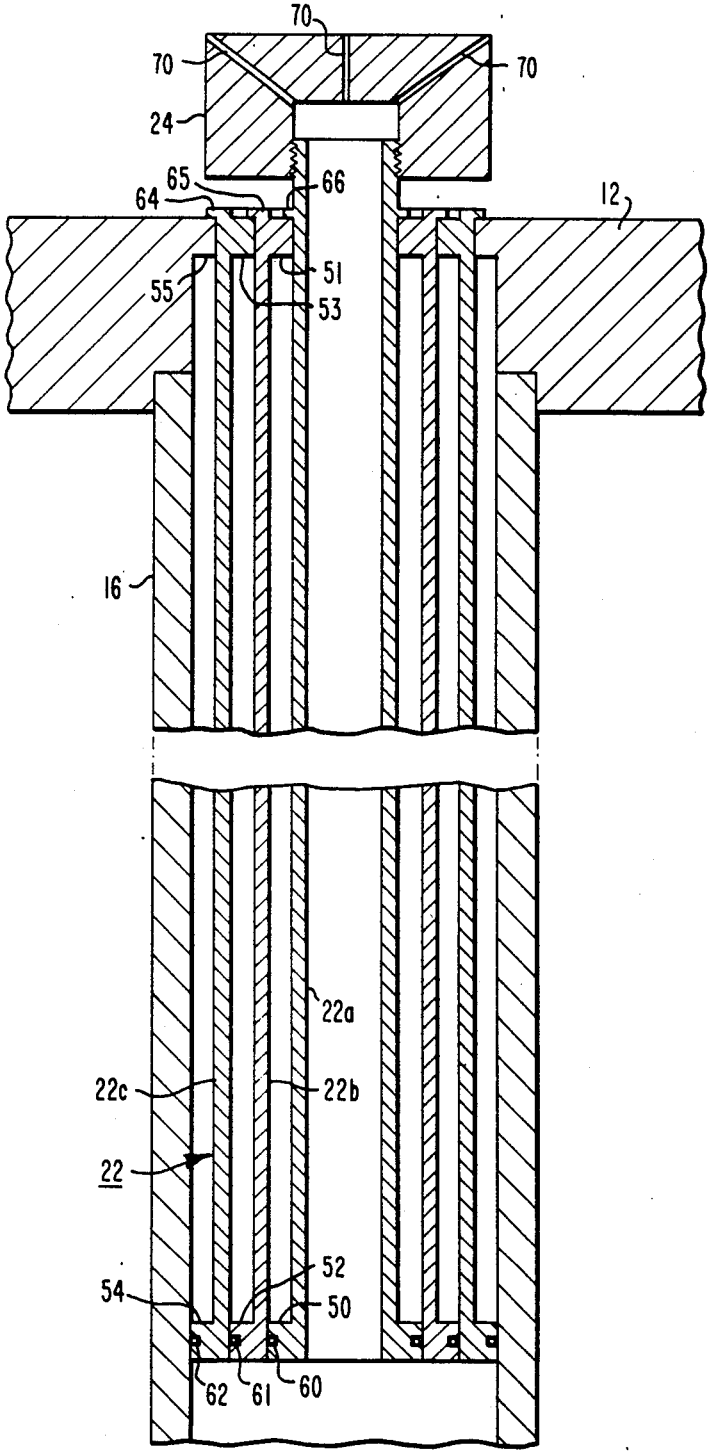
FIG. 4 is a cross sectional view illustrating the interior of the apparatus in more detail.

The tubing arrangement 22 is shown in more detail in FIG. 4. In the embodiment of FIG. 4, the tube arrangement 22 is comprised of a plurality of telescopic tube sections, three being illustrated by way of example, and taking the form of tube sections 22*a*, 22*b* and 22*c* of progressively larger diameters.

After or upon contact of the positively buoyant apparatus with the underside of the ice cap, fluid admission valve 18 (FIG. 1) will be opened so as to allow the water within the containment vessel 10 to enter support tube 16. In view of the high pressure of the gas forcing the water into the tube 16 the water is under a similar high pressure and causes the telescopic tube sections to extend to a full position wherein outer flange member 50 of tube section 22*a* is stopped by inner flange member 51 of tube section 22*b*; outer flange member 52 of tube section 22*b* is stopped by inner flange member 53 of tube section 22*c* and outer flange member 54 of tube member 22*c* is stopped by flange 55 of the cover 12.

High pressure fluid leakage between tube sections is restrained by means of O-rings 60 to 62 provided in the outer flange portions of tube members 22*a* to 22*c*. The tube sections are prevented from falling toward the bottom of support tubes 16 by the provision of a plurality of stop members such as stop member 64 connected to tube section 22*c* and overlying flange portion 55, stop member 65 connected to tube section 22*b* and overlying the top of tube member 22*c* and stop member 66 connected to tube member 22*a* and overlying the top of tube member 22*b*.

Nozzle 24 is connected to the end of the smaller diameter tube member 22*a* and contains a plurality of channels 70 for discharging the high pressure fluid into the ice formation.

Although FIG. 4 illustrates three telescopic tube sections it is to be understodd that a greater or lesser number of tube sections may be utilized with a consequent respective increase or decrease in the length of the apparatus. Where space requirement is not at a premium, the tube arrangement could be comprised of a single tube section of a length just greater than the thickness of the ice to be penetrated.

Figure 5:
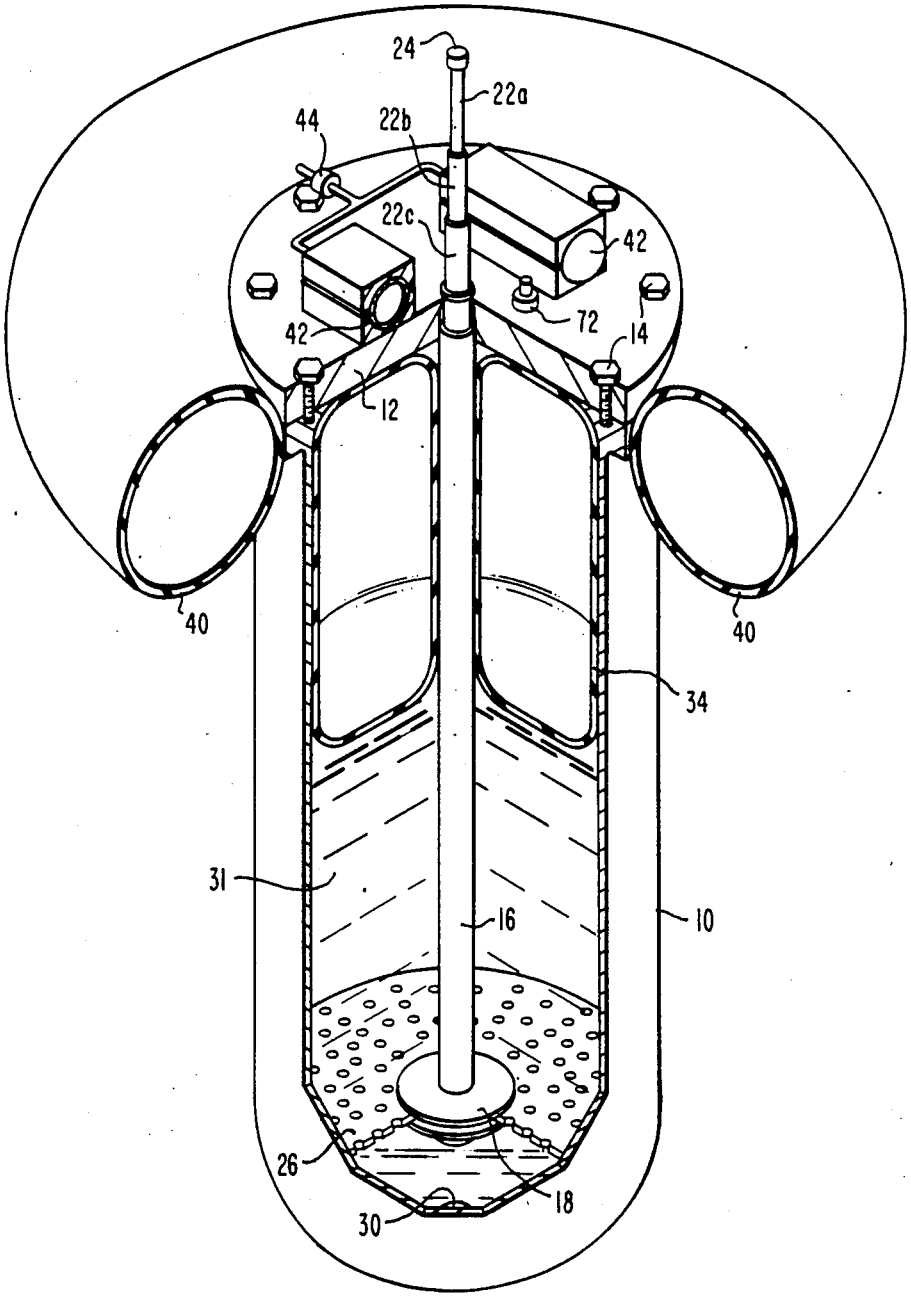
FIG. 5 is an isometric view of the apparatus, with a portion broken away, illustrating a deployed condition with the nozzle of FIG. 4 being extended.

FIG. 5 is an isometric view of the apparatus in the deployed condition, with a quarter section broken away thereby showing the apertured support member/filter 26 in more detail. Additionally, FIG. 5 illustrates a gas charging valve 72 which is connected with bladder 34 through cover 12 to initially charge the bladder to its high pressure state.

Figure 6:
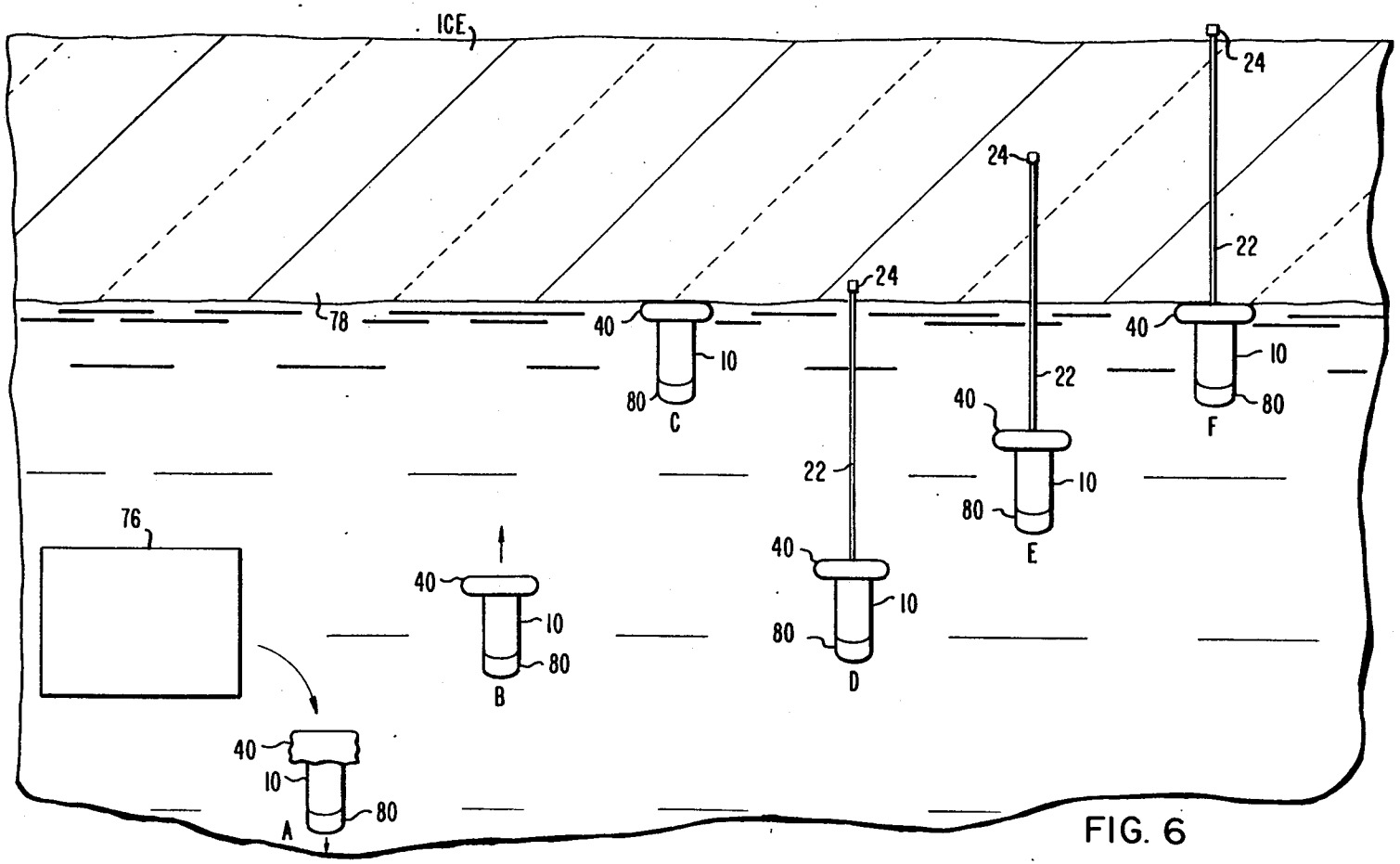
FIG. 6 illustrates a typical deployment of the apparatus.

FIG. 6 illustrates the deployment of the apparatus. In operation an underwater vehicle 76 traveling in the water beneath an ice cap 78 deploys the apparatus 10 which then assumes a vertical position as illustrated at A and starts sinking due to its slightly negative buoyancy. A sensor package 80 carrying a sensor as well as transmitting apparatus is illustrated as being connected to the bottom of containment vessel 10.

After a predetermined time period the buoyancy collar 40 is inflated as at position B so as to impart a positive buoyancy to the apparatus which then travels to the underside of ice cap 78.

After contact with the underside of ice cap 78, position C, fluid admission valve 18 (FIG. 1) is activated such as by the force of impact or a timer, by way of example. As soon as extension starts occurring, high pressure fluid emerging from the nozzle 24 starts to erode a hole in the ice cap while the remainder of the tube arrangement telescopes to its full position, as illustrated at D.

Due to the positive buoyancy force imparted by collar 40, the apparatus will advance vertically, as at E with the high pressure fluid continuously eroding a channel through the ice cap until such time as the apparatus contacts the under side of the ice cap 78 and the nozzle has completed its penetration of the ice cap, as illustrated at F. The sensor package may then be activated to perform its function and the results transmitted to a remote location with the tube arrangement 22 now projecting above the surface of the ice cap, acting as an antenna.

I claim:

1. Apparatus for penetrating an ice cap from the water medium below said ice cap, comprising:

(A) an elongated containment vessel;

(B) a central support tube disposed within said vessel and having a first end within said vessel and a second end open to the ambient medium;

(C) a fluid admission valve closing off said first end of said support tube;

(D) a tube arrangement disposed within said support tube and being extendable therefrom;

(E) a nozzle connected to the end of said tube arrangement which extends from said support tube;

(F) means for imparting positive buoyancy to said apparatus; and (G) means separating the inside of said containment vessel into respective (a) fluid and (b) high pressure gas chambers, whereby when said fluid admission valve is opened said high pressure gas will force said fluid to flow through said valve into said tube arrangement and out of said nozzle and in so doing, extend tube arrangement while the fluid exiting said nozzle erodes said ice to form a channel therethrough.

2. Apparatus according to claim 1 wherein:

(A) said means for imparting positive buoyancy is an inflatable collar connected to the upper portion of said elongated containment vessel.

3. Apparatus according to claim 2 which includes:

(A) a gas supply carried by said containment vessel; and (B) a remotely activated valve connecting said gas supply with said inflatable collar.

4. Apparatus according to claim 3 wherein:

(A) said containment vessel includes a top cover; and (B) said gas supply is carried by said top cover.

5. Apparatus according to claim 1 wherein:

(A) said separating means is an inflatable bladder; and which includes:

(B) valve means for connection to a high pressure source for inflating said bladder.

6. Apparatus according to claim 5 wherein:

(A) said bladder occupies the upper portion of the inside of said containment vessel and (B) said fluid occupies the lower portion of the inside of said containment vessel.

7. Apparatus according to claim 6 which includes:

(A) a bleed valve in said containment vessel to limit the level of fluid introduced into said containment vessel and for allowing discharge of air displaced as said bladder is inflated.

8. Apparatus according to claim 5 wherein:

(A) said bladder surrounds the upper portion of said central support tube.

9. Apparatus according to claim 1 which includes:

(A) a support member connected to limit lateral movement of said support tube.

10. Apparatus according to claim 9 wherein:

(A) said support member is a plate having a multiplicity of apertures so as to allow for water passage but not debris passage; and (B) said support member is positioned above said fluid admission valve.

11. Apparatus according to claim 1 wherein:

(A) said tube arrangement includes a plurality of coaxial telescopic and interlocking tube sections.

12. Apparatus according to claim 11 which includes:

(A) O-ring seals disposed at the base of each of said tube sections to prevent fluid flow between tube sections and between the outermost tube section and said support tube.

13. Apparatus according to claim 1 wherein:

(A) said fluid is water.

14. Apparatus for penetrating an ice cap from the water medium below said ice cap, comprising:

(A) an elongated containment vessel;

(B) a central support tube disposed within said vessel and having a first end within said vessel and a second end open to the ambient medium;

(C) a fluid admission valve closing off said first end of said support tube;

(D) a tube arrangement disposed within said support tube and being extendable therefrom;

(E) a nozzle connected to the end of said tube arrangement which extends from said support tube;

(F) means for imparting positive buoyancy to said apparatus;

(G) means for introducing a predetermined quantity of fluid into said containment vessel; and (H) means for pressurizing the inside of said containment vessel with a high pressure gas, whereby when said fluid admission valve is opened said high pressure gas will force said fluid to flow through said valve into said tube arrangement and out of said nozzle and in so doing, extend said tube arrangement while the fluid exiting said nozzle erodes said ice to form a channel therethrough.

15. An ice penetrator for making a hole through an ice cap from below the ice cap, comprising:

(A) a container unit adapted to be deployed in the water medium below said ice cap;

(B) means for imparting positive buoyancy to said container unit so that said container unit will contact the underside of said ice cap after said deployment;

(C) a source of fluid carried by said container unit;

(D) a nozzle extendible from said container unit;

(E) means for extending said nozzle after contact with said underside of said ice cap; and (F) means connecting said nozzle with said source of fluid after said contact with said underside of said ice cap whereby said fluid discharging from said nozzle erodes a hole in said ice cap as said nozzle is extended.

16. Apparatus according to claim 15 wherein:

(A) said fluid is under high pressure greater than that of said water medium.

17. Apparatus according to claim 15 wherein:

(A) said fluid is water.

* * * * *